US005875528A

United States Patent [19]

Parker

[11] Patent Number: 5,875,528

[45] Date of Patent: Mar. 2, 1999

[54] CREMATION URN

[75] Inventor: Daniel J. Parker, Connersville, Ind.

[73] Assignee: Batesville Casket Company, Inc., Batesville, Ind.

[21] Appl. No.: 733,882

[22] Filed: Oct. 18, 1996

[51] Int. Cl.[6] ..... A61G 17/08

[52] U.S. Cl. ..... 27/1

[58] Field of Search ..... 27/1, 2, 35, 7, 27/14, 17

[56] References Cited

U.S. PATENT DOCUMENTS

| | | | |
|---|---|---|---|
| D. 169,347 | 4/1953 | Woodward . | |
| D. 248,171 | 6/1978 | Sugarman . | |
| D. 263,088 | 2/1982 | Krech . | |
| D. 356,421 | 3/1995 | Parker . | |
| D. 370,766 | 6/1996 | Parker . | |
| D. 370,767 | 6/1996 | Parker . | |
| D. 370,768 | 6/1996 | Parker . | |
| 2,562,726 | 7/1951 | MacDonald et al. | 21/1 |
| 3,925,944 | 12/1975 | Pickel | 52/134 |
| 4,199,848 | 4/1980 | Kohnert | 27/1 |
| 4,324,026 | 4/1982 | Craft . | |
| 5,029,373 | 7/1991 | Raymond | 27/1 |
| 5,732,452 | 3/1998 | Riedel, II | 27/1 |

OTHER PUBLICATIONS

Nature, Whale Family, ©Meisner Gallery/NY 1995, 1 sheet (front and back).

Nature, Finish Line, ©Meisner Gallery/NY 1995, 1 sheet (front and back).

Nature, Fishing Hole, ©Meisner Gallery/NY 1995, 1 sheet (front and back).

Nature, Baby Elephant, ©Meisner Gallery/NY 1995, 1 Sheet (front and back).

Nature, Future Promise, ©Meisner Gallery/NY 1995, 1 sheet (front and back).

Nature, Panther, ©Meisner Gallery/NY 1995, 1 sheet (front and back).

Fine Art Acrylics, "*Lonely Hunter*", Grizzly Venture, Polar Seclusion, Walrus, Crystal Pond, Pride Of The Prairie, undated, 4 pages.

*Primary Examiner*—Kien T. Nguyen

*Attorney, Agent, or Firm*—Wood, Herron, & Evans, L.L.P.

[57] ABSTRACT

A cremation urn comprises a first mass and a second mass contained within the first mass. The second mass includes an opening communicating with a cavity within the second mass for receiving cremated remains. At least a portion of the first mass is transparent so as to permit viewing of at least a portion of the second mass through the transparent portion of the first mass. A cover is closable over the opening to retain the cremated remains within the cavity. In another embodiment the first mass includes at least one window permitting viewing of at least a portion of the second mass therethrough. In another aspect a cremation urn comprises a mass including an opening communicating with a cavity within the mass for receiving cremated remains, the cavity defining a cremated remains container. At least a portion of the mass is transparent so as to permit viewing of at least a portion of the container through the transparent portion of the mass. In another embodiment the mass includes at least one window permitting viewing of at least a portion of the container therethrough.

42 Claims, 2 Drawing Sheets

CREMATION URN

FIELD OF THE INVENTION

This invention relates generally to funeral products, and more particularly to cremation urns for displaying cremated human remains contained therein.

BACKGROUND OF THE INVENTION

Cremation is a growing segment of the funeral industry. Consequently, there is an increasing demand for more and higher quality styles and designs of cremation urns.

One popular design theme for cremation urns is the outdoor/animal theme. Four such designs are disclosed in U.S. Pat. Nos. Des. 356,421, 370,767, 370,766 and 370,768, all of which are assigned to the assignee of the present invention and are hereby incorporated by reference herein as if fully set forth in their entirety.

Such cremation urn designs may include rather delicate features and the like which could be subject to damage and/or breakage during the handling thereof. It would therefore be desirable to provide a means of protecting such delicate features of a cremation urn yet without obstructing the view thereof.

Further, in the case of U.S. Pat. Nos. Des. 356,421 and 370,767, which include dolphins suspended above rock and/or coral as if swimming in water, it would be desirable to more closely simulate the water in which the dolphins or other aquatic animals are swimming.

Accordingly, it is one object of the present invention to provide a cremation urn which includes a means of protecting yet not obstructing delicate features thereof.

It is another objective of the present invention to provide a cremation urn which more closely simulates water in which aquatic animals are swimming.

It is yet another objective of the present invention to provide a cremation urn which creates a more visually appealing and life-like three dimensional appearance, whether in the case of aquatic animals swimming in water, or in the case of, for example, birds flying in the air.

SUMMARY OF THE INVENTION

In accordance with the stated objectives, the present invention is a cremation urn. The cremation urn comprises a first mass and a second mass contained within the first mass. The second mass includes an opening communicating with a cavity within the second mass for receiving cremated remains. At least a portion of the first mass is transparent so as to permit viewing of at least a portion of the second mass through the transparent portion of the first mass. A cover is closable over the opening to retain the cremated remains within the cavity.

In a preferred form, the second mass may be opaque. The second mass may include a decorative configuration and/or surface ornamentation which is viewable through the transparent portion of the first mass. The second mass may take one of many decorative forms, for example aquatic forms such as that of a submerged land mass or coral mass. The second mass may include swimming aquatic animals suspended thereover, for example dolphins.

The first and second masses may preferably be fabricated of acrylic. The first mass may preferably included a textured outer surface which is translucent and at least one transparent window through which the portion of the second mass is viewable. In a preferred form, the second mass may include a front window, a back window, a pair of side windows and at least one top window through which the portion of the second mass is viewable.

The cover of the cremation may preferably be opaque and be removably securable with screws.

In another embodiment of this aspect of the invention, a cremation urn is provided which comprises a first mass and a second mass contained within the first mass. The second mass includes an opening communicating with a cavity within the second mass for receiving cremated remains. The first mass includes at least one window permitting viewing of at least a portion of the second mass therethrough. A cover is closable over the opening to retain the cremated remains within the cavity.

In another aspect of the present invention, a cremation urn comprises a mass including an opening communicating with a cavity within the mass for receiving cremated remains, the cavity defining a cremated remains container. At least a portion of the mass is transparent so as to permit viewing of at least a portion of the container through the transparent portion of the mass. A cover is closable over the opening to retain the cremated remains within the cavity. The container may preferably include a decorative configuration and/or surface ornamentation associated therewith viewable through the transparent portion of the mass.

In another embodiment of this aspect of the invention, a cremation urn is provided which comprises a mass including an opening communicating with a cavity within the mass for receiving cremated remains, the cavity defining a cremated remains container. The mass includes at least one window permitting viewing of at least a portion of the container therethrough. A cover is closable over the opening to retain the cremated remains within the cavity.

One advantage of the present invention is that a cremation urn is provided which includes a means of protecting delicate features of the cremation urn yet which does not visually obstruct those features.

Another advantage of the present invention is that a cremation urn is provided which more closely simulates water in which aquatic animals are swimming.

Yet another advantage of the present invention is that a cremation urn is provided which creates a more visually appealing and life-like three dimensional appearance of animals in their environments, for example aquatic animals swimming in water or birds flying in the air.

These and other objects and advantages of the present invention will become more readily apparent during the following detailed description taken in conjunction with the drawings herein, in which:

DETAILED DESCRIPTION OF THE INVENTION

Figure 1:
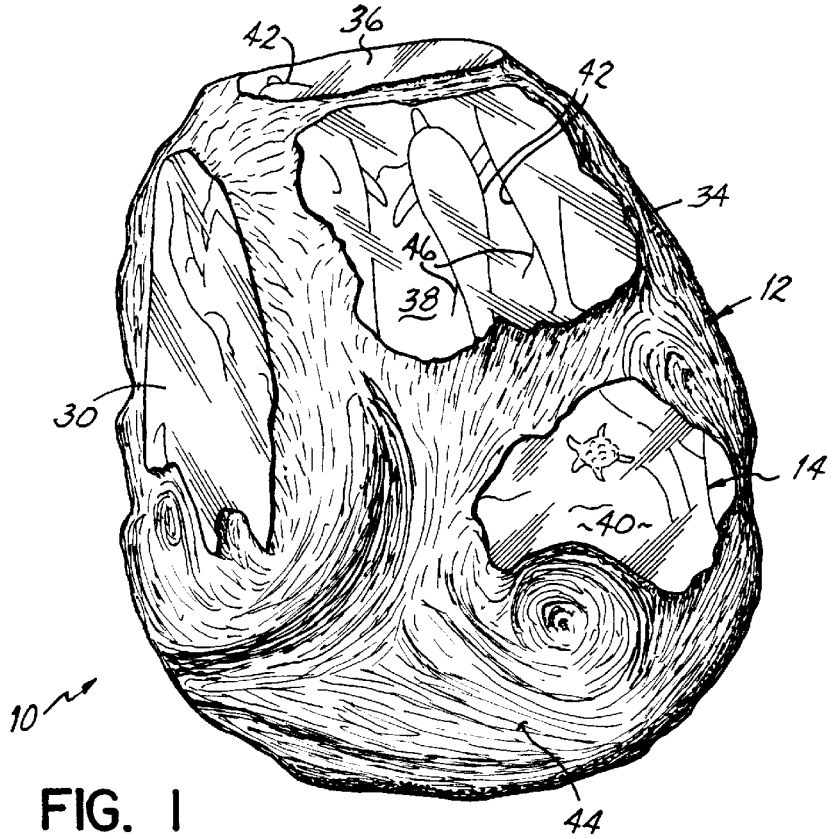
FIG. 1 is a right, rear perspective view of the cremation urn of the present invention.
Figure 2:
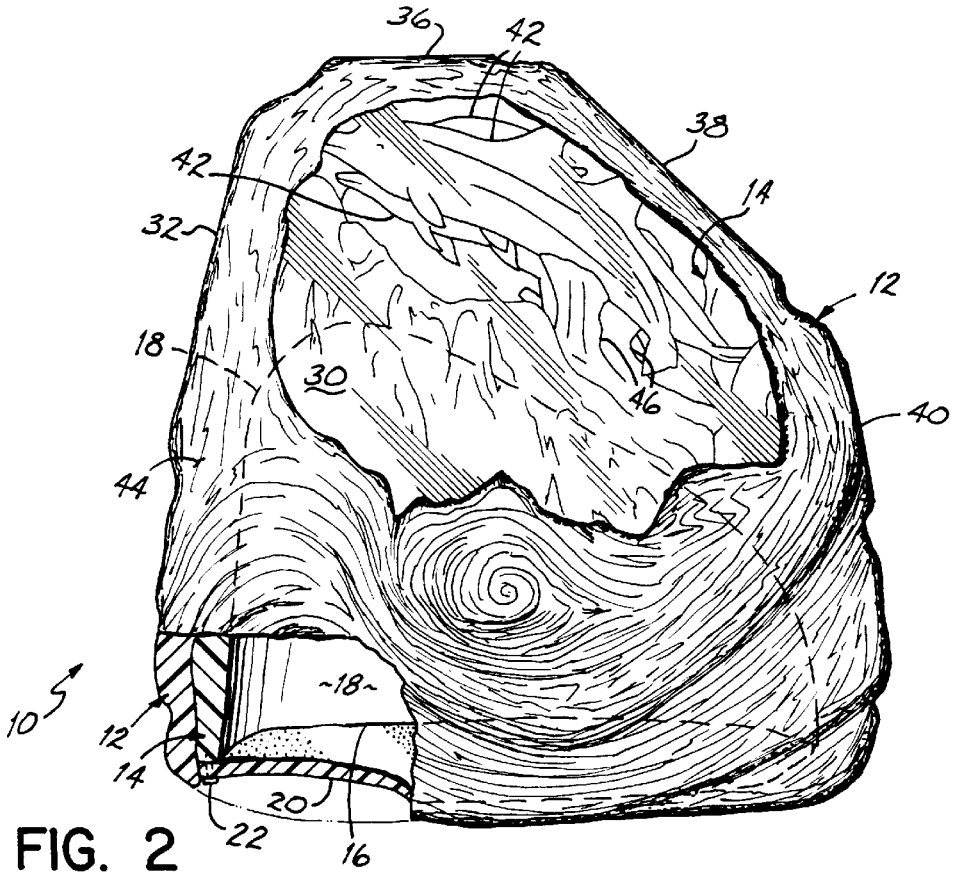
FIG. 2 is a right side perspective view of the cremation urn of FIG. 1.
Figure 3:
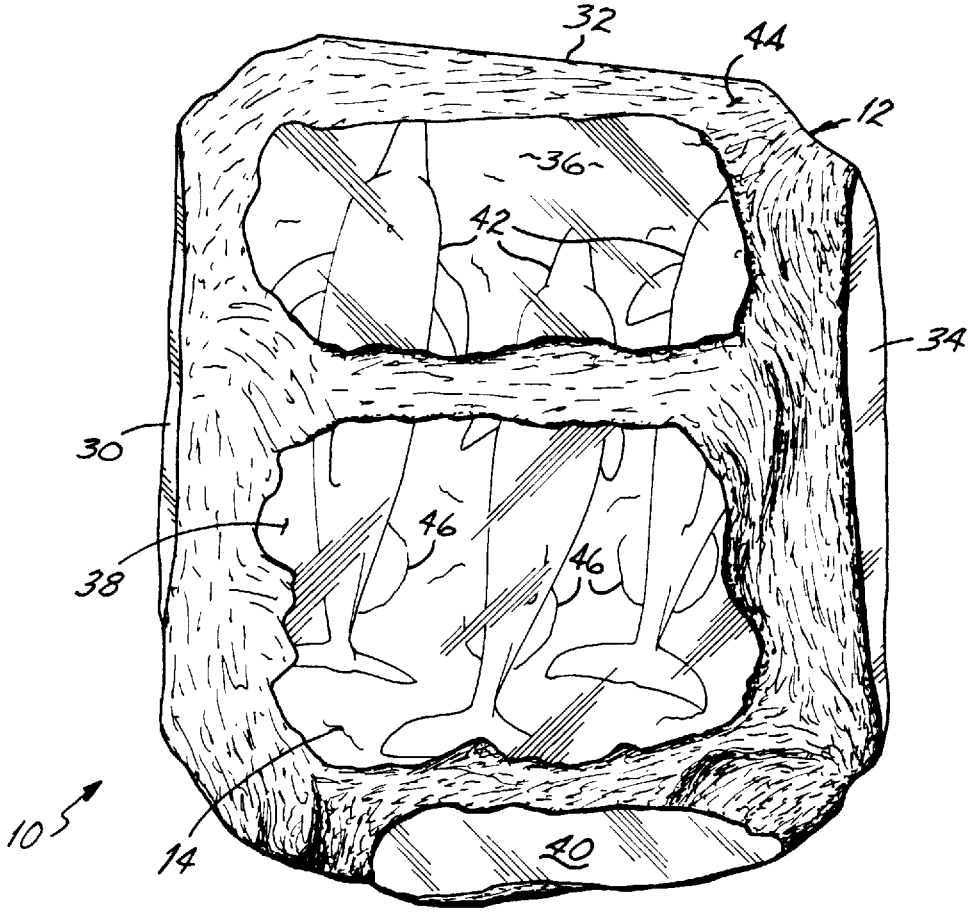
FIG. 3 is a top perspective view of the cremation urn of FIG. 1.

Referring to the drawings, there is illustrated a cremation urn 10 according to the principles of the present invention. In a preferred form of the present invention, the urn 10 includes a first mass 12 and a second mass 14 contained within the first mass 12. The second mass 14 includes an opening 16 which communicates with a cavity 18 for receiving cremated remains. A cover 20 is closable over the opening 16 via screws 22 to retain the cremated remains within the cavity 18. Mass 12 is provided with transparent portions 30, 32, 34, 36, 38 and 40 or otherwise is provide with windows so as to permit viewing of portions or all of the second mass 14. Alternatively, the entire mass 12 could be transparent.

The second mass 14 is preferably opaque to hide the cremated remains contained within the cavity 18 of the mass 14. The mass 14 may include a decorative configuration and/or surface ornamentation associated therewith which is viewable through the transparent portions or windows 30, 32, 34, 36, 38 and 40 of the mass 12. For example, as illustrated mass 14 may take the form of a land mass or a coral mass. Further, the mass 14 may include aquatic animals, for example dolphins 42, fixed thereatop. Of course it will be appreciated that it is contemplated that the mass 14 and figurines 42 may take other shapes or forms and therefore the invention is not limited to the specific shapes and forms illustrated, those being merely a preferred embodiment.

The first and second masses 12 and 14 are preferably fabricated of acrylic, as are the dolphins 42. Mass 12 is fabricated of transparent acrylic and includes a textured surface 44 which results in the textured surface areas being translucent, with the portions 30, 32, 34, 36, 38 and 40 of the mass 12 being transparent. Mass 14 is preferably fabricated of acrylic which has been tinted with a color, for example white, to provide an opaque quality to the mass 14. Like mass 14 cover 20 is preferably opaque and is fabricated of acrylic.

In the manufacture of the urn 10 of the present invention, the mass 14 with cavity 18 therein is first molded. Once it has cured the dolphins 42 are attached as by gluing to support columns 46 also fabricated of white acrylic which themselves are attached as by gluing to the mass 14. After the mass 14 is outfitted with the dolphins 42 the mass 14 and dolphins 42 are encapsulated in clear acrylic having the above described outwardly facing textured surface areas 44 and smooth surface areas 30, 32, 34, 36, 38 and 40. These areas 30, 32, 34, 36, 38 and 40 may be polished etc. after the mass 12 has cured to enhance visibility of the mass 14 therein.

Alternatively, the cremation urn 10 could be fabricated as a single mass including an opening communicating with a cavity within the mass for receiving cremated remains, the cavity defining a cremated remains container. The cavity could have a decorative configuration and/or surface ornamentation upon the interior surface of the cavity. A portion or all of the container would then be visible through the windows or transparent portions of the mass. Further, the entire single mass could be transparent.

Still further, the areas 30, 32, 34, 36, 38 and 40 could be made completely open to the inner mass 14 thereby providing an outer shell or framework with windows therein surrounding the inner mass.

Those skilled in the art will readily recognize numerous adaptations and modifications which can be made to the present invention which will result in an improved cremation urn, yet all of which will fall within the spirit and scope of the present invention as defined in the following claims. Accordingly, the invention is to be limited only by the scope of the following claims and their equivalents.

What is claimed is:

1. A cremation urn comprising:

a first mass;

a second mass contained within said first mass, said second mass including an opening communicating with a cavity within said second mass for receiving cremated remains;

at least a portion of said first mass being transparent so as to permit viewing of at least a portion of said second mass through said transparent portion of said first mass; and a cover closable over said opening to retain the cremated remains within said cavity;

wherein said second mass includes at least one dolphin figurine mounted thereatop; and wherein said first mass includes a front window, a back window, a pair of side windows and at least one top window through which said portion of said mass is viewable.

2. The cremation urn of claim 1 wherein said second mass is opaque.

3. The cremation urn of claim 1 wherein said second mass includes a decorative configuration associated therewith viewable through said transparent portion of said first mass.

4. The cremation urn of claim 1 wherein said second mass includes a decorative surface ornamentation associated therewith viewable through said transparent portion of said first mass.

5. The cremation urn of claim 1 wherein said second mass is in the form of a land mass.

6. The cremation urn of claim 1 wherein said second mass is in the form of a coral mass.

7. The cremation urn of claim 1 wherein said second mass includes at least one dolphin figurine mounted thereatop.

8. The cremation urn of claim 1 wherein said first mass is fabricated of acrylic.

9. The cremation urn of claim 1 wherein said second mass is fabricated of acrylic.

10. The cremation urn of claim 1 wherein said first mass has a textured outer surface and at least one transparent window through which said portion of said second mass is viewable.

11. The cremation urn of claim 10 wherein said textured outer surface is translucent.

12. The cremation urn of claim 1 wherein said cover is opaque and is removably securable with screws.

13. A cremation urn comprising:

a mass including an opening communicating with a cavity within said mass for receiving cremated remains, said cavity defining a cremated remains container;

at least a portion of said mass being transparent so as to permit viewing of at least a portion of said container through said portion of said mass; and a cover closable over said opening to retain the cremated remains within said cavity;

wherein said mass has a textured outer surface and at least one transparent window through which said portion of said container is viewable; and wherein said mass includes a front window, a back window, a pair of side windows and at least one top window through which said portion of said container is viewable.

14. The cremation urn of claim 1 wherein said container includes a decorative configuration associated therewith viewable through said transparent portion of said mass.

15. The cremation urn of claim 13 wherein said mass includes a decorative surface ornamentation associated therewith viewable through said transparent portion of said mass.

16. The cremation urn of claim 13 wherein said container is in the form of a land mass.

17. The cremation urn of claim 13 wherein said container is in the form of a coral mass.

18. The cremation urn of claim 13 wherein said container includes at least one dolphin figurine mounted thereatop.

19. The cremation urn of claim 13 wherein said mass is fabricated of acrylic.

20. The cremation urn of claim 13 wherein said cover is opaque and is removably securable with screws.

21. The cremation urn of claim 13 wherein said textured outer surface is translucent.

22. A cremation urn comprising:

a first mass;

a second mass contained within said first mass, said second mass including an opening communicating with a cavity within said second mass for receiving cremated remains;

at least a portion of said first mass being transparent so as to permit viewing of at least a portion of said second mass through said transparent portion of said first mass; and a cover closable over said opening to retain the cremated remains within said cavity:

wherein said first mass includes a front window, a back window, a pair of side windows and at least one top window through which said portion of said second mass is viewable.

23. A cremation urn comprising:

a cremation urn mass including an opening communicating with a cavity within said mass for receiving cremated remains said cavity defining a cremated remains container;

at least a portion of said mass being transparent so as to permit viewing of at least a portion of said container through said transparent portion of said mass; and a cover closable over said opening to retain the cremated remains within said cavity;

wherein said mass includes a front window, a back window, a pair of side windows and at least ones top window through which said portion of said container is viewable.

24. An urn for carrying cremation remains, the urn comprising:

a cremation urn mass defining a cremated remains container and an opening communicating with the container, the mass having a textured outer surface and a plurality of transparent windows through which at least a portion of the container is viewable, the plurality of transparent windows including a front window, a back window, a pair of side windows, and a top window.

25. A cremation urn comprising:

a cremation urn container including a wall defining a cavity for carrying cremated remains, and means for protecting the container without visually obstructing the container wherein the protecting means includes an outer framework surrounding the container, wherein the framework is formed to include a plurality of windows through which at least a portion of the container is viewable, the plurality of windows including a front window, a back window, a pair of side windows, and a top window.

26. The urn of claim 25, wherein the container includes an outer surface having delicate features and the protecting means includes means for protecting the delicate features without visually obstructing those features.

27. The urn of claim 25, wherein the protecting means includes a mass surrounding the container.

28. The urn of claim 25, wherein the framework is formed to include at least one window so that the container can be viewed through the framework.

29. A cremation urn comprising:

a cremation urn mass made from transparent material, and a cremation urn container embedded in the mass, the container being visible through the mass, wherein the mass includes an outer surface having at least one textured portion the textured portion being opaque, further comprising a figurine embedded in the mass, the figurine being visible through the mass.

30. The urn of claim 29, wherein the outer surface includes at least one transparent portion, the container being visible through the transparent portion.

31. The urn of claim 29, wherein the figurine engages the container.

32. The urn of claim 31, wherein the figurine is attached to the container.

33. The urn of claim 29, wherein the figurine is a dolphin.

34. The urn of claim 29, wherein the figurine is a support column.

35. The urn of claim 29, wherein the container is made from transparent material.

36. The urn of claim 29, wherein the container is made from the same material from which the mass is made.

37. The urn of claim 36, wherein the material from which the container is made is tinted with color.

38. The urn of claim 37, wherein the color is white so that the container has an opaque quality.

39. A cremation urn comprising:

a first cremation urn mass, a second cremation urn mass contained within the first mass, the second mass including an outer surface that is visible through the first mass, and a container attached to the first mass, the container defining a cavity for carrying cremation remains.

40. The urn of claim 39, wherein the container is embedded in the first mass.

41. A cremation urn comprising:

a first cremation urn mass, a second cremation urn mass contained within the first mass, the second mass including an outer surface that is visible through the first mass, and a container attached to the second mass, the container defining a cavity for carrying cremation remains.

42. The urn of claim 41, wherein the container is embedded in the first mass.

* * * * *

UNITED STATES PATENT AND TRADEMARK OFFICE

CERTIFICATE OF CORRECTION

PATENT NO. : 5,875,528
DATED : March 2, 1999
INVENTOR(S) : Daniel J. Parker

It is certified that error appears in the above-indentified patent and that said Letters Patent is hereby corrected as shown below:

Column 4, line 19, insert -- second -- after "said" and before "mass".,(2nd occurrence)

Column 4, line 55, insert -- transparent -- after "said" and before "portion".

Column 4, line 65, "of claim 1" should read -- of claim 13 --.

Column 5, line 46, "ones" should read -- one --.

Signed and Sealed this

Twenty-first Day of September, 1999

*Attest:*

Q. TODD DICKINSON

*Attesting Officer*

*Acting Commissioner of Patents and Trademarks*